US009453403B2

(12) United States Patent
Hörman

(10) Patent No.: US 9,453,403 B2
(45) Date of Patent: Sep. 27, 2016

(54) METHOD AND ARRANGEMENT TO ESTABLISH DURING DOWN-THE-HOLE DRILLING COMMUNICATION BETWEEN THE CAVITY OF THE DRILL STRING AND THE SURROUNDING MATERIAL

(75) Inventor: Magnus Hörman, Älta (SE)

(73) Assignee: LKAB WASSARA AB, Stockholm (SE)

( * ) Notice: Subject to any disclaimer, the term of this patent is extended or adjusted under 35 U.S.C. 154(b) by 559 days.

(21) Appl. No.: 13/983,533

(22) PCT Filed: Jan. 26, 2012

(86) PCT No.: PCT/SE2012/050076

§ 371 (c)(1),
(2), (4) Date: Oct. 21, 2013

(87) PCT Pub. No.: WO2012/108818

PCT Pub. Date: Aug. 16, 2012

(65) Prior Publication Data

US 2014/0034300 A1 Feb. 6, 2014

(30) Foreign Application Priority Data

Feb. 7, 2011 (SE) ..... 1150083

(51) Int. Cl.
*E21B 47/00* (2012.01)
*E21B 49/08* (2006.01)

(52) U.S. Cl.
CPC ..... *E21B 47/00* (2013.01); *E21B 49/08* (2013.01)

(58) Field of Classification Search
CPC ..... E21B 4/14; E21B 10/36; E21B 47/00; E21B 49/08
See application file for complete search history.

(56) References Cited

U.S. PATENT DOCUMENTS 3,578,078 A 5/1971 Shillander
3,760,887 A * 9/1973 Palauro ..... B25D 9/26 173/206

(Continued)

FOREIGN PATENT DOCUMENTS

EP 0399426 A1 11/1990
EP 0394255 B1 12/1994

OTHER PUBLICATIONS

International Search Report received for PCT Patent Application No. PCT/SE2012/050076 mailed on May 8, 2012, 4 pages.

(Continued)

*Primary Examiner* — William P Neuder
(74) *Attorney, Agent, or Firm* — Morrison & Foerster LLP

(57) ABSTRACT

The invention concerns a method to establish communication between the inner cavity of a drill string and the surrounding material down in a drill hole (60) during the use of a down-the-hole drill unit with a drill string (10), a down-the-hole hammer drill (1), and a source of pressurized medium (11) that delivers a medium under pressure to the down-the-hole hammer drill. Communication is established through: (a) that a tube section (10:1) of the drill string (10) is assigned openings (17), (b) that a piston (15) with an axial channel (16) is arranged, (c) that the piston (15) is inserted into the cavity of the tube section (10:1) in a manner that allows sliding, (d) that the piston (15) allows driving fluid to be led through a channel (16) from the source of pressure (11) to the down-the-hole hammer drill (1), (e) that the piston (15) is assigned a first part (40) of a recovery means (45), which part can be united with a second part (41), (f) that a lifting arrangement (42) is arranged at the surface level, (g) that the second connector (41) of the recovery means (45) is lowered into the drill hole (60), the piston (15) is fished up out of the drill hole and the compartment in the cavity of the tube section (10:1) that is formed is used as a measurement compartment.

9 Claims, 2 Drawing Sheets

(56) References Cited

Figures 1A, 1B, 1C:
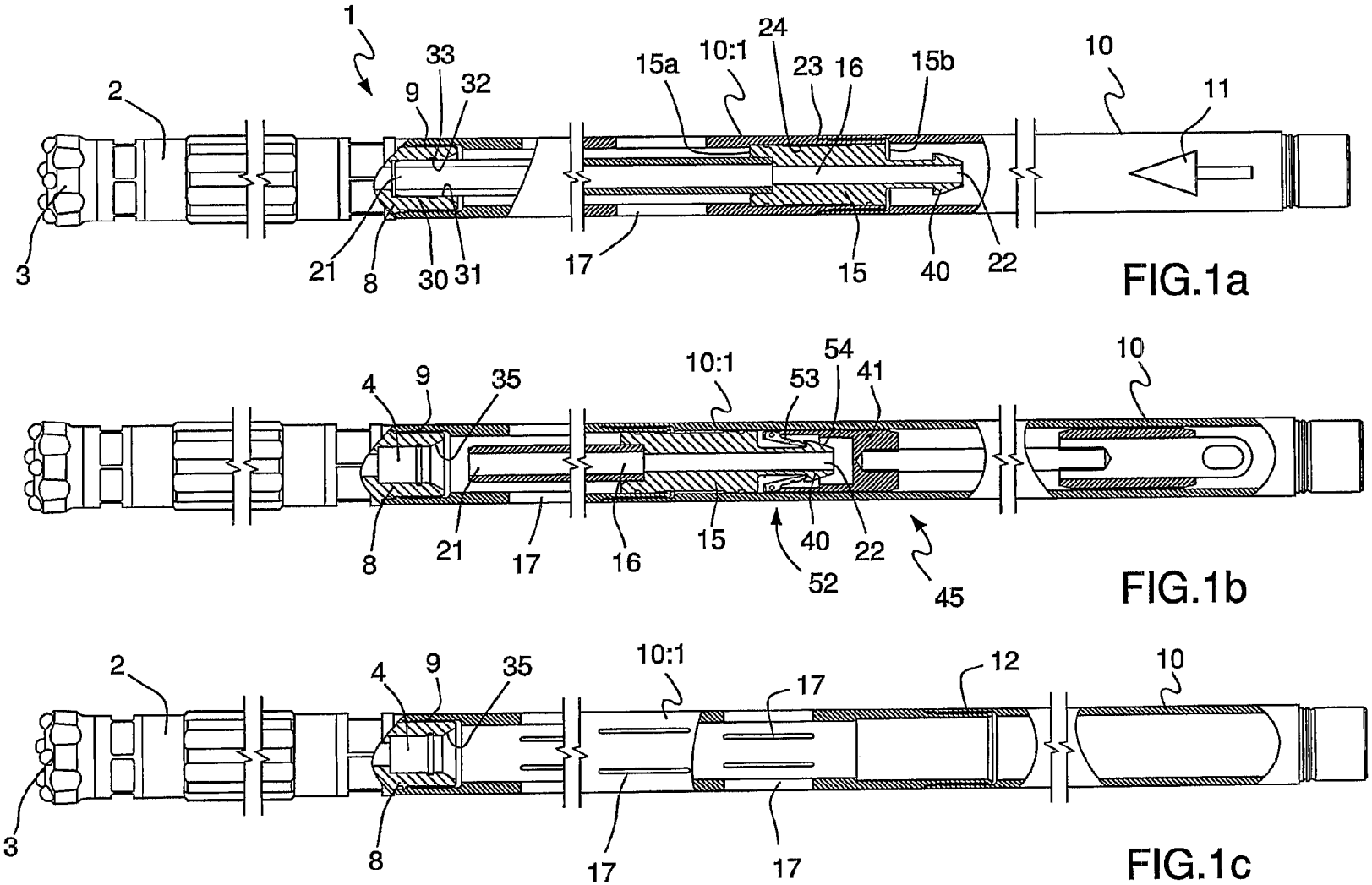

U.S. PATENT DOCUMENTS 5,210,918 A * 5/1993 Wozniak ..... B25D 9/14 173/17
6,170,573 B1 * 1/2001 Brunet ..... E21B 23/10 166/153
6,295,867 B1 10/2001 Mahaffey
2005/0029017 A1 2/2005 Berkheimer et al.

OTHER PUBLICATIONS

International Preliminary Report on Patentability received for PCT Patent Application No. PCT/SE2012/050076, mailed on Aug. 22, 2013, 7 pages.

* cited by examiner 1
2
3
4
8
9
10
10:1
11
12
15
15a
15b
16
17
21
22
23
24
30
31
32
33
35
40
41
45
52
53
54

10
11
10:1
22
21
60
40
15
2
3

42
41
10:1
40
60
15

42
40
15
41
10:1
60

47
50
60

METHOD AND ARRANGEMENT TO ESTABLISH DURING DOWN-THE-HOLE DRILLING COMMUNICATION BETWEEN THE CAVITY OF THE DRILL STRING AND THE SURROUNDING MATERIAL

CROSS REFERENCE TO RELATED APPLICATION

This application is a U.S. National Phase patent application of PCT/SE2012/050076, filed on Jan. 26, 2012, which claims priority to Swedish Patent Application No. 1150083-2, filed on Feb. 7, 2011, which is hereby incorporated by reference in the present disclosure in its entirety.

The present invention concerns a method to establish during down-the-hole drilling communication between the cavity of the drill string and the surrounding material, according to the introduction to claim 1. The establishment of communication makes it possible for media, such as groundwater surrounding the drill rod down in the drill hole, to flow into and fill the cavity of the drill string. The possibility of establishing such communication allows measurements to be carried out rapidly and simply in situ, down in the drill hole. The invention concerns also an arrangement for the execution of the method according to the introduction to claim 5.

During down-the-hole drilling and the formation of drill holes in the ground that are limited by a drill string consisting of a number of drill rods coupled at their ends there arises in many cases a need of achieving communication between the cavity of the tube lining and the material that surrounds the drill string, for example in order to lead media such as water from the surrounding material into the cavity of the drill string. The purpose of this is to carry out after drilling measurement-based investigations down in the material, which investigations may concern temperature, flows and groundwater levels, whereby measuring instruments are passed down in a compartment for measurement, a measurement compartment, that is limited by the cavity of the drill string. This type of measurement normally includes measurement of the permeability of the ground, i.e. the amount of water that must be pumped away in order to obtain a certain lowering of the water level in, for example, a pond or similar collection of water. The permeation through the ground, in situ, is calculated in known manner through measurement of discharge following Darcy's Law: $Q=CHK$, from which it can be derived that the amount pumped is proportional to the fall of water level H and to the permeability K. This makes it possible to calculate the amount pumped as a function of these two parameters when the coefficient C is known, which can be determined by theoretical or experimental methods using the form of the contact surfaces between the water in the drill hole and the ground, i.e. the surfaces through which water is filtered into a limited measurement compartment. Conversely, it is possible to calculate K with the aid of measurements of the amount pumped and the lowering of the surface of the water in the measurement compartment, which constitutes the value of the permeability from the surrounding ground into the measurement compartment in situ. The equation above thus gives as its result the flow of water in cubic meters per second ($m^3/s$).

The measurement compartment is limited by what is known as a tube liner, which is provided in certain parts of its circumference, in particular at its lower part, with one or several openings with an area of opening that has been determined in advance. The openings allow groundwater to flow into the measurement compartment, and the coefficient C can in this way be determined.

In order to be able to work as rapidly and efficiently as possible, it is desirable that during the procedure known as down-the-hole drilling, in which a drill string consisting of a number of drill rods, coupled to each other at their ends and attached at a down-the-hole hammer drill, is used, to use the drill string to form the desired measurement compartment and the possibility of being able to carry out measurement work at different levels down in the drill hole, without any special tube lining being needed. In other words, it is desirable to have the possibility of being able to lower the required measuring instruments directly down into the drill string in situ without needing to take the circular route of forming a post hoc specially designed tube liner with measurement openings arranged in the outer surface of the tube liner.

Among the many advantages of this are, of course, the saving of time that can be obtained when the measurements required can take place directly down in the drill hole, together with the cost savings achieved through the requirement for equipment for lining of the drill hole being eliminated or reduced. It is, therefore, desirable to make it possible to carry out during down-the-hole drilling measurements in situ down in a drill hole, in particular down in a drill hole in the ground, in order to achieve higher cost efficiency.

A first purpose of the present invention, therefore, is to achieve a method that makes it possible to achieve communication immediately after down-the-hole drilling between the cavity of the drill string and the material that surrounds the drill string, not least in order to be able to carry out measurements in situ down in a drill hole. A second aim of the present invention is to achieve an arrangement for the execution of the method. These two aims of the invention are solved through the method demonstrating the distinctive features and characteristics that are specified in claim 1, and through an arrangement that demonstrates the distinctive features and characteristics that are specified in claim 5. Other advantages of the invention are made clear by the non-independent claims.

The down-the-hole drill may in one design be of single-use type, i.e. the down-the-hole hammer drill can be left down in the drill hole after the drilling and the measurements have been carried out.

The invention will be described in more detail below in the form of a non-limiting embodiment with reference to the attached drawings in which:

FIGS. 1*a*-1*c* show longitudinal sections in different stages through an arrangement according to the invention, mounted in a drill section that is position farthest forward in a drill string equipped with a down-the-hole drill.

FIGS. 2*a*-2*d* show schematically in a number of stages that follow one after the other the procedures that are required in order to establish communication between the cavity of the drill string and the material that surrounds it, together with the execution of measurements in situ down in a drill hole in the ground, according to the invention.

With reference to FIGS. 1*a*-1*c*, there is shown a forward end of a down-the-hole hammer drill 1 that has a machine housing 2 that is principally circularly symmetrical, in which is mounted an impact mechanism driven by pressurised fluid, which impact mechanism is arranged to give impacts onto a drill bit 3 that is mounted through a splined connector in a chuck in a manner that allows reciprocating motion. The machine housing 2 has a central supply line 4 for driving liquid, such as a driving fluid of water, and channels in the drill bit 3 (not shown in the drawing) through which channels used driving liquid can flow out, and through the influence of this drill cuttings generated during the drilling are driven backwards and upwards along the outer surface of the machine housing. This type of down-the-hole hammer drill has long been known and can be constituted by, for example, the type that is described in EP 0394255. The present arrangement will be described arranged at a fluid-driven down-the-hole drill, but it should be understood that the arrangement according to the invention is not limited to such: it can be arranged at a down-the-hole drill of any type that is prevalent, for example a pneumatic down-the-hole drill of the type that uses air under pressure as its driving medium. The machine housing 2 is provided at the rear, at the inlet side for driving fluid, with an end piece 8 that is connected by means of a threaded connector 9 to a drill string 10 consisting of a number of sections of drill rod that are axially connected at their ends. The drill bit 3 is turned during drilling by means of rotation of the drill string 10, as is illustrated by the looped arrow in FIG. 2*a*. Driving fluid for the driving of the down-the-hole hammer drill is supplied from a pump, not shown in the drawings, at the surface level, through the channel 11 in the drill string 10. The channel 11 in the cavity of the drill string 10 thus functions as a source of pressure. New drill rods are joined onto the drill string 10, and the drill string becomes longer as the hole becomes deeper. In order for it to be possible to extend the drill string 1 through the joining on of further drill rod sections, these are connected in a manner that allows their release with neighbouring parts by means of a connector 12 comprising a thread that connects meeting tube sections in a fluid-tight manner.

The technology described above constitutes essentially prior art technology.

Once again with reference to FIGS. 1*a*-1*c*, there is mounted in the tube section of the drill string 10 located at the front and denoted 10:1, i.e. the tube section that is at the deepest position in the drill hole, an extended piston 15 that can be slid axially within the cavity of the cylindrical tube section 10:1. The piston 15 has an axial penetrating central channel 16 that allows driving fluid to be led in a controlled manner directly from the source of pressure to the down-the-hole hammer drill 1 when the piston is located at its most withdrawn position. Motion of fluid between the piston 15 and the cavity of the tube section 10:1 is not possible, such that a compartment located after the piston, seen from the source of pressure, i.e. the compartment between the piston and the machine housing 2, is not in fluid-transmitting communication with the source of pressure.

As is made most clear by FIG. 1*c*, the tube section 10:1 that is located farthest forward is provided on its outer surface with a number of longitudinal groove-shaped holes or openings 17, which allow, for the execution of measurements down in the drill hole, water to flow into the cavity of the tube section. The function of the said openings 17 will be described in more detail below. The cavity of the forward tube section 10:1 can, due to the presence of the openings 17 limit a measurement compartment. The term "measurement compartment" as it is used here denotes a compartment that is isolated from the surroundings by a tube lining that allows water from the surroundings to flow into the compartment through one or several openings that have been arranged in the outer surface of the tube lining with an open area that has been determined in advance. The piston 15 is located concentrically in the tube section 10:1 and is intended to move axially in a manner that allows sliding within the tube section in controlled interaction with the cylinder bore that the cavity of the tube section forms. The piston 15 has an outlet for driving fluid that is limited by a forward relatively extended tubular part 21 manufactured from high-quality steel, and an inlet for driving fluid that is limited by a rear, relatively short, tubular part 22. The rear tubular part 22 is designed as a continuous integrated part of the piston 15, i.e. as a single entity with this piston. In order to further improve the fluid-excluding properties of the piston 15, it is first provided with a surrounding seal 23 of a polymer material. The seal 23 is mounted in a groove-shaped depression 24 on the outer circumference of the piston 15.

As has been described above, the machine housing 2 comprises a central channel 4 intended to lead driving fluid into the impact mechanism that is located within the machine housing of the impact hammer when the piston 15 is located at its most withdrawn position, in contact with the impact hammer 1 in a manner that allows fluid to flow. A tube muff 30 is arranged at the rear free end of the end piece 8 of the machine housing 2 intended for interaction in a manner that allows fluid to flow with the forward end 21 of the tube of the piston. The tube muff 30 has a ring-shaped cylindrical compartment 31 that surrounds a plastic collar or sealing ring 32 that is seated in a ring groove 33 in the compartment, and through which the forward end 21 of the section of tube interacts in a sealing manner when the section of tube is located inserted into the tube muff, as shown in FIG. 1*a*. The piston 15 is driven towards its most withdrawn position through the influence of the hydrostatic force that the driving fluid in the channel 11 exerts onto the end surface 15*b* of the piston 15 that faces the source of pressurised medium 11 (the pump, symbolised by an arrow in FIG. 1*a*) during drilling. By ensuring that a hydraulic imbalance exists between the relevant end surfaces 15*a* and 15*b* of the piston, i.e. by ensuring that the end surface 15*b* of the piston 15 that faces the source of pressurised medium 11 (the pump) has an area that always is larger than the area of the second end surface 15*a* of the piston, it is guaranteed that the piston, even in the continuum that is established, attempts to reach a position that is in connection with the end piece 8 of the machine housing 2 in a manner that allows fluid to flow. The dimensions of the sealing ring 32 and the ring groove 33 are so selected that a fluid-tight effect is obtained when the forward end 21 of the tube of the piston 15, which end serves as outlet, is located inserted into the end piece 8 of the machine housing 2. In order to ensure that the forward end 21 of the tube of the piston 15 glides in a correct manner into a position that gives sealing in the tube muff 30 of the end piece 2, the end piece comprises a conical inner surface 35, i.e. a conical expansion intended to interact with the first end 21 of the tube of the piston. It should be understood that the central channel 16 of the piston 15 forms an extension backwards of the central channel 4 of the machine housing 2 and thus a shunt that can lead driving fluid past the openings 17 that are formed in the outer surface of the first tube section 10:1 when the outlet of the piston 15 is located at its most withdrawn position and in connection with the impact hammer through the tube muff 30 in the rear end piece 8 of the machine housing 2 in a manner that allows fluid to flow.

The inlet for driving fluid to the piston 15, i.e. the rear relatively short tubular part 22, at the same time forms one of two interacting connectors 40 and 41 that can be united axially, and that are designed as male and female parts. These two connectors 40, 41 are components of a recovery means generally denoted by 45, with the aid of which the piston 15 can be fetched up out of the drill string 10. The said second connector 41, designed as a female part, is fixed to the end of a wire or similar that is a component of a lifting arrangement generally denoted by 42. This second connector 41 is intended to be suspended by a wire or similar and lowered down into the drill hole with the aid of suitable lifting gear located at the surface (not shown in the drawings). The term "lifting arrangement" is used below to denote any lifting crane that is equipped with steel wires, pulley blocks or similar means and that can be used to raise and lower objects.

It should be pointed out that it is the general custom to name objects that have been inserted into a drill hole as "fish", and a tool designed to recover such an object as a "fishing tool".

Electrical measurement signals are transferred through a line 47 to and from a measurement tool 50 or a sensor suspended from the lifting arrangement when the present arrangement is used during the execution of measurement-based investigations in a drill hole. These measurements may be constituted by any presently available measurements and may include, for example, temperature, rate of flow, and level of groundwater. The measurement signals obtained may alternatively be transferred by telemetry, i.e. in a wireless manner, using for example, a radio link or an optical link between a transmitter down in the drill hole and a receiver at the surface level.

As is made most clear by FIGS. 1*a* and 1*b*, the second connector 41, fixed at the end of the lifting arrangement 42, comprises a locking means generally denoted by 52 that, equipped with spring-loaded locking pins 53, can enter into locking interaction with the first connector 40 formed as an end part 54 of a free end of the rear tubular part 22 of the piston, which end part 54 is extended radially relative to the axial direction. The locking effect is obtained by the locking pins 53 engaging behind the said radially extended end part 54, i.e. the locking pins move towards the part of the tubular part that has a smaller diameter. In order to achieve a secure engagement in which the locking pins 53 snap into place behind the end part 54, not only the locking pins but also the radially extended end part have been given designs with markedly sharp edges.

A closer study of FIG. 1*c* will reveal that the groove-shaped openings 17 have been given such locations on the circumference of the first or most forwardly located tube section 10:1 relative to the total length of the piston 15 that the central channel 16 of the piston forms a shunt or backwards extension of the central channel 4 of the machine housing 2 for direct communication with the source of pressure. Due to the sealing effect between the piston 15 and the ring-shaped inner cavity of the first tube section 10:1, driving fluid is blocked from leaking into the compartment of the tube section 10:1 between the piston 15 and the machine housing 2, and thus from leaking out through the groove-shaped openings 17. Driving fluid is instead forced to flow directly through the central channel 16 of the piston 15 from the source of pressure (the pump) to the down-the-hole hammer drill 1.

The arrangement described above thus makes it possible to establish communication between the cavity of the drill string and the surrounding material in a drill hole, and thus to carry out measurements in situ in the drill hole.

Figures 2A, 2B, 2C, 2D:
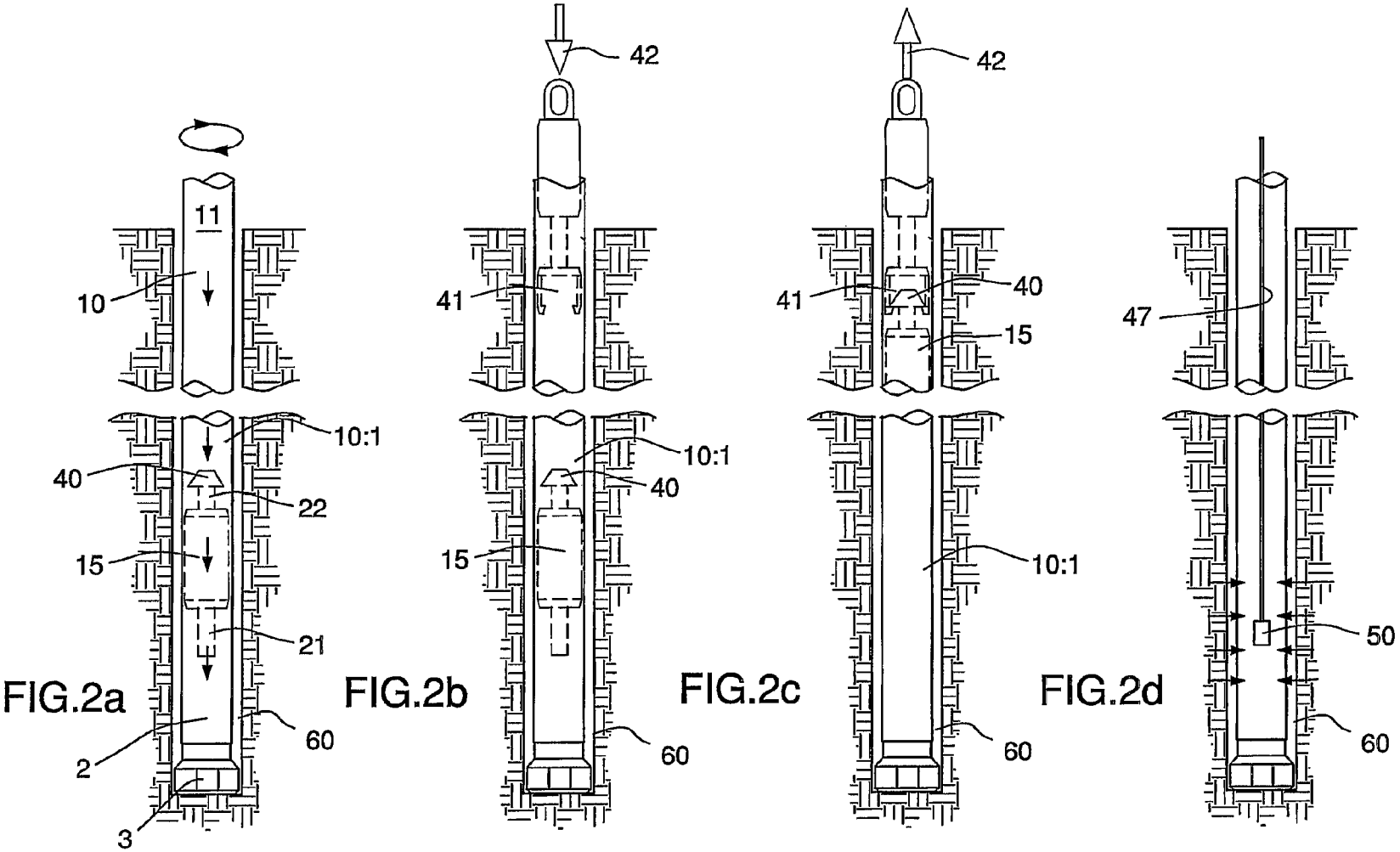

A down-the-hole drilling unit is shown in FIG. 2*a* that, consisting of a down-the-hole hammer drill 1 fixed at one end of a drill string 10, is located in one piece down in an essentially vertical drill hole 60 and where a driving flow is supplied by a source of pressurised medium that is connected to a second end of the drill string, whereby, in order to make it possible to carry out sampling in situ, the following measurements and steps must be taken:

that a first tube section 10:1 intended to form a part of the drill string 10 is assigned one or several openings 17 with a total area of opening at the circumference of the outer surface of the tube section that has been determined in advance, that a piston 15 demonstrating an inlet 22 and an outlet 21 for leading a flow of driving fluid through the piston is arranged, that the piston 15 is constructed such that it can glide axially along the cavity of the first tube section 10:1 and that it is oriented such that the outlet of the piston faces the inlet 8 for the flow of driving fluid into the down-the-hole hammer drill 1, that the inlet 8 of the down-the-hole hammer drill 1 and the outlet 21 of the piston 15 are given such a mutually operative form that they can be connected and disconnected through axial displacement of the piston in the first tube section 10:1 from a situation that allows fluid to flow, whereby the flow of driving fluid from the source of pressurised medium to the down-the-hole hammer drill is led, when fluid is allowed to flow, through the piston, that the inlet 22 of the piston is assigned one part of a first and second interacting recovery means 40, 41, designed as male and female parts, that allow the piston 15 to be fished up out of the drill string 10 through the second part being lowered down into the drill string.

The arrangement functions in the following manner.

With reference to FIGS. 2*a*-2*d*, a drill hole has been produced in the ground by means of the down-the-hole drilling unit in which the required driving fluid for the down-the-hole hammer drill has been connected directly from the source of pressurised medium 11 to the down-the-hole hammer drill through the piston 15 in its transfer position in the tube section 10:1 that is located farthest forward. When the down-the-hole drilling unit has reached the required depth, the piston 15 is recovered from the drill string 10 through the said second interacting part 41 of the fishing tool being lowered by a lifting arrangement down into the drill hole, as is shown in FIG. 2*b*. After uniting the two interacting connectors 40, 41, the piston 15 is lifted up the drill hole 10 by means of the lifting arrangement 42, as is shown in FIG. 2*c*. In the free measurement compartment that is limited by drill hole in the ground, which drill hole is lined by the drill string 10, water flows through the openings 17 from the surrounding bedrock into the measurement compartment. As is shown in FIG. 2*d*, a measuring instrument or sensor 50 is lowered suspended from a lifting arrangement to the desired level in the measurement compartment, after which the desired measured values, concerning, for example, the permeability of the ground, are recorded. The measurement data obtained is transferred with the aid of suitable transfer means, which may include an electrical cable that extends along the wire of the lifting arrangement or, alternatively, wireless communication over a radio link, to a receiver at surface level (not shown in the drawings).

The invention is not limited to what has been described above and shown in the drawings: it can be changed and modified in several different ways within the scope of the innovative concept defined by the attached patent claims.

The invention claimed is:

1. A method to allow communication to be established between an inner cavity of a drill string and a surrounding material in situ down in a drill hole during use of a down-the-hole drill unit that includes the drill string formed from a number of drill rods coupled at ends thereof, a down-the-hole hammer drill fixed at one end of the drill string, and a source of pressurised medium that delivers a medium under pressure to the down-the-hole hammer drill and that is connected to another end of the drill string, the method comprising operational steps:

(a) that a tube section of the drill string having at an outer cover thereof one or several openings with an area of opening that has been determined in advance is provided, (b) that a piston with an axial penetrating channel is arranged, (c) wherein the piston is arranged so as to glide axially inside the cavity of the tube section, (d) wherein the piston is designed so as to allow driving fluid to be led through the channel from the source of pressure to the down-the-hole hammer drill when the piston is located at a most withdrawn position thereof in the tube section and in contact with the down-the-hole drill unit in a manner that allows fluid to flow, (e) wherein the side of the piston that faces the source of pressure has a first connector of a recovery unit, which first connector can be coupled together in a retaining manner with a second connector that is a component of the recovery unit, (f) that a lifting arrangement is arranged at a surface level in connection with the drill hole, and (g) that the second connector of the recovery unit, fixed at the lifting arrangement that is arranged at the surface level, is caused to enter into retaining interaction with the first connector by being lowered down into the drill hole by the lifting arrangement, after which the piston is fished up out of the drill hole by the lifting arrangement, so that a compartment that is formed in the cavity of the tube section as a result of fishing up of the piston can be used as a measurement compartment.

2. The method according to claim 1, wherein measurements are carried out in situ down in the measurement compartment formed in the drill hole, through execution of the following operational steps:

(h) that after drilling and fishing up of the piston have been carried out, a measuring instrument or a sensor is lowered by the lifting arrangement to a determined level in the measurement compartment formed, and (i) that the measured values obtained are recorded by the measuring instrument and transferred as electrical signals through a cable or by telemetry to the surface level for further processing.

3. The method according to claim 1, wherein the piston is driven towards the most withdrawn position during drilling by a hydrostatic pressure that the driving medium supplied by the source of pressure exerts on an end surface of the piston that faces towards the source of pressurised medium.

4. The method according to claim 1, wherein the openings at the outer cover are arranged in a first tube section of the drill string, the first tube section being located farthest down in the drill hole and next to the down-the-hole hammer drill, and the piston is arranged so as to glide inside an inner cavity of the first tube section.

5. An arrangement to establish communication between a hollow cavity of a drill string that is a component of a down-the-hole drill unit and a surrounding material in situ down in a drill hole, wherein a down-the-hole hammer drill is fixedly attached at one end of the drill string and a source of pressurised medium is connected to another end of the drill string at a surface level, which source supplies a medium under pressure to the down-the-hole hammer drill, the arrangement comprising:

a tube section that has one or several openings in an outer surface thereof, which openings have a total area of opening that is determined in advance, a piston that is arranged so as to form a seal with an inner open wall of the drill string and is arranged to move axially along and inside a drill rod, wherein the piston has a penetrating channel that allows a flow of driving fluid under pressure to be led through the piston and the establishment of communicating flow between the source of pressurised medium and the down-the-hole hammer drill when the piston is located at a most withdrawn position thereof in the tube section in contact with the down-the-hole hammer drill in a manner that allows fluid to flow, in which position the pressurised medium from the source is led through the channel to the down-the-hole hammer drill, a lifting arrangement located at the surface level and located in connection with the drill hole, a recovery unit including first and second connectors that can be united in a retaining manner, of which the first connector is arranged at the piston and faces the source of pressure, while the second connector is fixed at the lifting arrangement and can be lowered into the drill hole by the lifting arrangement in order to interact with the first connector, wherein the piston is fished up out of the drill hole by the lifting arrangement after the drilling has been carried out.

6. The arrangement according to claim 5, wherein the channel of the piston is limited by tubular parts that, extending axially out from a corresponding end of the piston, form an outlet and an inlet, respectively, for the flow through of pressurised medium, where the tubular part that forms the outlet is located in interaction in a manner that does not allow fluid to pass with a pipe muff arranged in the rear end piece of the machine housing when the piston is located in the most withdrawn position in the drill string.

7. The arrangement according to claim 6, wherein the recovery unit includes the first and second connectors designed as male and female parts and arranged to interact in a retaining manner with each other through a snap-on effect.

8. The arrangement according to claim 5, wherein the lifting arrangement is arranged for the lowering of the second connector of the recovery unit into the drill hole and interaction with the first connector, which is arranged at the piston, and for the lifting of the piston from the drill hole after the connectors have been united.

9. The arrangement according to claim 5, wherein the down-the-hole hammer drill comprises a machine housing the inlet of which for the flow of driving fluid is limited by a pipe muff arranged at a rear end piece thereof, in which pipe muff the tubular part that forms the outlet of the piston for the flow through of driving medium is located in a manner that does not allow fluid to pass when the piston is located at the most withdrawn position in the tube section.

* * * * *